US006003690A

United States Patent [19]

Allen et al.

[11] Patent Number: 6,003,690

[45] Date of Patent: Dec. 21, 1999

[54] DEVICE FOR HOLDING CURRENCY NOTES

[76] Inventors: Leslie Edwin Allen, 42 Murchison Street, Marysville, Victoria 3779; Patrick William Cormack, 77 King Edward Avenue, Albion, Victoria 3020, both of Australia

[21] Appl. No.: 08/742,289

[22] Filed: Nov. 4, 1996

[30] Foreign Application Priority Data

Dec. 5, 1995 [AU] Australia ..... 40225/95

[51] Int. Cl.[6] ..... G07G 1/00

[52] U.S. Cl. ..... 211/51; 210/190

[58] Field of Search ..... 211/51, 50; 312/50, 312/187, 190, 291, 348.5; 206/555, 449, 565; 235/22

[56] References Cited

U.S. PATENT DOCUMENTS

| | | | |
|---|---|---|---|
| 380,490 | 4/1888 | Jewell | 211/51 X |
| 416,298 | 12/1889 | Morton | 312/190 X |
| 557,623 | 4/1896 | Sternberger | 211/51 |
| 947,512 | 1/1910 | Sellick | 211/51 |
| 1,291,474 | 1/1919 | Geimer | 211/51 X |
| 2,594,653 | 4/1952 | Jertson | 206/565 X |
| 3,892,309 | 7/1975 | Coffey et al. | 211/51 X |
| 5,451,753 | 9/1995 | Leatherwood et al. | 235/22 X |

FOREIGN PATENT DOCUMENTS

| | | | |
|---|---|---|---|
| 619381 | 9/1990 | Australia . | |
| 1010095 | 7/1995 | Australia . | |
| 1503045 | 3/1978 | United Kingdom | 312/204 |

*Primary Examiner*—Janet M. Wilkens
*Attorney, Agent, or Firm*—Ladas & Parry

[57] ABSTRACT

A device suitable for hindering the removal of currency notes stored in a cash drawer comprising an arm pivotably mountable to the cash drawer and a covering plate having an area for substantially covering a currency note, the covering plate being attached to the arm, so that when the arm is pivotably mounted to the drawer the covering plate may be located in a position where it substantially covers one or more currency notes stored in the drawer. The plate and the arm are pivotably connected and an abutment can be provided between the plate and the arm to limit pivotable movement therebetween.

20 Claims, 5 Drawing Sheets

DEVICE FOR HOLDING CURRENCY NOTES

FIELD OF THE INVENTION

The present invention is directed to a device for substantially covering currency notes located in a cash drawer thereby providing a means to hinder the unauthorised removal of these notes from the drawer.

BACKGROUND AND PRIOR ART

Typically, currency notes are stored in the drawers of cash registers in retail outlets. As store employees are continually placing money into and removing money out of the drawers during the course of business, the cash registers are usually placed in a location in the store where there is ready access to the drawers, ie on or next to a counter and at about waist height. Unfortunately, this often means that the drawers when opened are within view and reach of other people in the store and when a drawer is opened, it can be easy for a thief to reach their hand over to the drawer and quickly grab the currency notes located in the drawer.

SUMMARY OF THE INVENTION

It is an object of the present invention to provide a device that can be used in conjunction with a cash register drawer and other drawers in which cash is stored to hinder someone attempting to quickly remove currency notes stored in the drawer, yet still allow a cashier to have easy access to the currency notes when required. Accordingly, in one aspect the present invention is directed to a device suitable for hindering the removal of currency notes stored in a cash drawer comprising an arm pivotably mountable to the cash drawer and a covering means having an area for substantially covering a currency note, the covering means being attached to the arm, wherein when the arm is pivotably mounted to the drawer the covering means may be located in a position where it substantially covers one or more currency notes stored in the drawer.

In operation, the device can be attached to a cash drawer and is locatable in a position where the covering means substantially covers the currency notes in the drawer, thus hindering anybody trying to quickly grab the currency notes out of the drawer. Throughout the description this position shall be referred to as the covering position. The device is also movable to a position where the covering means does not substantially cover the currency notes so as to allow the cashier to easily remove the notes from the drawer and place notes into the drawer.

In a preferred embodiment, the covering means has one or more note contact surfaces located in substantially one plane for contacting a currency note located in the drawer so that the covering means is adapted to hold one or more currency notes substantially flat against a substantially flat surface of the drawer.

The holding of currency notes in a substantially flat state for a period of time can assist in the removal or reduction of creases in the note thereby improving the condition of the note. Furthermore creasing in notes increases the amount of space taken up by a stack of notes. By storing the notes in a substantially flat state, more notes can be stored in a single stack in a cash drawer. Plastic notes are prone to creasing and therefore the considerations noted above are particularly relevant to these type of notes.

The invention may of course be used to substantially cover a stack of currency notes positioned one on top of the other. In a preferred embodiment it can be used to hold substantially flat a stack of currency notes against a flat surface of a cash drawer. For example, a stack of currency notes can be placed adjacent the bottom surface of a cash drawer and the covering means may directly contact the uppermost note of the stack and press down on the stack of notes to hold all of the notes in a substantially flat state.

It is noted earlier that this device is suitable for mounting to a cash drawer in which currency notes can be stored. The drawer may be a cash register drawer divided into different compartments for receiving different denominations of currency and a device of this invention may be located adjacent each compartment.

It is preferred that the covering means is a single plate having a note contacting surface for covering and holding substantially flat one or more currency notes. The plate can be of any shape so long as it has a sufficient area to hold a currency note flat and substantially cover the note. For example, if the device is to contact a currency note, the plate may be of a rectangular shape to cover a substantial portion of the note. Furthermore, it is preferred that the plate has a recess or cut away portion, preferably in the front end of the plate. This allows a person positioned in front of the cash drawer to contact a currency note positioned underneath the plate whilst the plate in contact with the note so that the person can slide the note out from underneath the plate. This assists in allowing a person to remove a note from underneath the plate whilst the plate is in contact with the note. However, as the note is still substantially covered by the plate, it is difficult for a person to quickly grab the currency note located beneath the plate.

The plate need not be rectangular. For example, it could be an "H" shape. Alternatively, the covering means may comprise a plurality of plates that provide a number of note contacting surfaces that may cover and contact a currency note.

The plate or plurality of plates may be made out of a transparent material such as plastic and are preferably made from polycarbonate. This allows a person to view the currency notes located beneath the plate or plates when the device is mounted to the drawer and is in contact with the notes. The plate can be injection moulded.

Alternatively, instead of a single plate or plurality of plates, the covering means could consist of a plurality of contact points located in substantially one plane that contact the currency note, the number and positioning of the contact points being sufficient to substantially cover the currency note and to hold the currency note in a substantially flat state. For example, the covering means may comprise five arms that radiate out from a central point, with four of the arms extending out to contact the four corners of the note and the fifth arm contacting the centrepoint of the note. This device substantially covers the currency note and hinders access to the note thereby making it more difficult for a person to quickly grab the note from the drawer. It also contacts a sufficient number of points on the note to hold it substantially flat.

It is preferred that the device includes a biasing means that is connectable to the cash drawer for biasing the covering means towards a position where it substantially covers the currency note when the device is mounted to the drawer. Such a biasing means includes a spring attached to the pivotable arm and attachable to the drawer. Biasing of the covering means towards the covering position makes it more difficult to remove a currency note positioned beneath the covering means, if the covering means directly contacts the note and presses down on the note. Furthermore, if the covering means is a plate adapted to contact and hold the currency note substantially flat, biasing of the plate towards the flat surface of the drawer increases the pressure placed on the currency note by the plate and this can increase the effectiveness of the plate to hold the currency note flat.

In a preferred embodiment of this invention, the covering means is pivotably mounted to the pivoting arm of the device. This is especially preferred where the covering means is also adapted to hold the currency note substantially flat against a flat surface in a cash drawer. For example where the covering means is a plate the skilled addressee will appreciate that to hold the note flat the note contacting surface of the plate should preferably be substantially parallel to the flat surface of the drawer when the plate is in contact with the note. By pivotably connecting the plate to the arm, the note contacting surface of the plate can remain substantially parallel to the flat surface of the drawer as the plate is located at various locations either toward or away from the flat surface. This enables the contact means to hold in a substantially flat state different amounts of currency notes arranged in a single stack.

In a preferred embodiment the covering means can have located on an upper surface one or more housings having an aperture for receiving one or more projections located on the arm. Preferably there are two housings located on the covering means for receiving two projections located on the arm. Each projection can be located in an aperture in a housing to allow pivotable attachment of the covering means to the arm. Furthermore the two projections can be located towards a lower end of the arm and positioned so that they extend either side of the arm, the housings on the covering means being located so that the end of the arm can be positioned between the two housings to allow the projections on either side of the arm to extend into the housings. The upper end of the arm is also pivotably attachable to the cash drawer. The upper end may have projections extending either side of the arm to allow pivotable connection to apertures located in the cash drawer in much the same manner as the arm is pivotably connected to the covering means.

Alternatively, the arm may comprise an elongate structure folded over so that is has a "W" shape. In this embodiment, the covering means may include on its upper surface one or more projections defining openings to receive the lower portions of the "W" shaped arm. Preferably the one or more projections are hook-like projections.

In a preferred embodiment, the pivoting arm can be connected to the covering means at a number of different selected points on the covering means. This allows the position of the covering means to be moved relative to the arm so that the device can be attached to cash drawers of different sizes.

It is preferred to limit the degree the covering means can pivot relative to the arm. If the covering means is a plate, the plate may be locatable in an almost vertical position when the arm is pivotably attached to a drawer and is raised to an upright position. As the arm is rotated from the upright position towards the bottom of the cash drawer, if the plate is able to remain upright, an end of the plate will contact the bottom of the drawer as the arm is lowered thereby hindering further movement of the arm. One way to prevent this is to limit the degree the plate can rotate relative to the arm. This can be achieved by attaching the plate or other contacting means to the arm at a point adjacent a lower end of the arm so that a portion of the lower end extends past this point of attachment. As the plate of this embodiment is rotated relative to the arm, the plate reaches a point where the lower end of the arm abuts the top of the plate thereby preventing further rotation. It is further preferred that the lower portion of the arm is angled with respect to the longitudinal axis of the arm so that one or more feet are formed at the lower end of the arm. The foot or feet may have substantially flat lower surfaces for abutting the upper surface of the plate to limit its rotation.

Alternatively, an abutment means can be placed on top of the plate or covering means in a location so that rotation of the plate or other covering means brings the abutment means into contact with the arm thereby preventing further rotation of the plate or other covering means.

It is preferable to limit the degree of rotation of the covering means relative to the arm to less than 90 degrees.

Where the device includes a biasing means, the biasing means may be located so that it assists in holding the device mounted to the drawer in the upright position. For example, where the biasing means is a spring, it may be located so that movement of the device away from the upright position towards the bottom surface of the drawer initially causes the spring to expand. Therefore, when the device is located approximate to the upright position, it is biased towards the upright position by the spring. Accordingly, in a further preferred embodiment of this invention, the biasing means biases the covering means towards the upright and covering positions when the device is approximate the upright and covering positions respectively, but biases the covering means away from a position intermediate the upright and covering positions.

In a further embodiment, the present invention is directed to a plate for use as a covering means in the device described earlier. The plate has a note contacting surface and an area for substantially covering a currency note, and further has an upper surface and attachment means located on the upper surface to allow pivotable attachment of the plate to an arm. Preferably the attachment comprises at least one housing, more preferably two housings, each housing having an aperture for receiving a projection located on the end of an arm. Preferably there are two such housings that are located on the plate so to receive the projections extending out from either side of one end of the arm. In this embodiment the end of the arm can be located substantially between the housings when it is attached to the plate.

In an alternative embodiment, the attachment means is one or more projections located on the upper surface of the plate, each projection defining an opening for receiving a portion of an arm. For example, where the arm is an elongate structure bent into a "W" shape, the projections may be hook shaped and located on the plate so that each projection is suitable for receiving a lower portion of the "W" shaped arm. It is preferable that the lower end of such an arm and/or the one or more projections located on the plate are made from a resilient material so that there is an interference fit between the one or more projections and the arm.

In a preferred embodiment there is located on the upper surface of the plate an abutment means, wherein the abutment is capable of being brought into contact with an arm when an arm is attached to the plate so as to limit the rotational movement of the plate relative to the arm. The abutment means maybe an elongate projection extending up from the upper surface of the plate and located near the front of the plate. Preferably the plate is substantially the same size as a currency note so that it can substantially cover the currency note when it is in contact with the note. It is also preferable to include a cut out or recess portion in the plate to allow a person to contact a currency note placed under the plate. The cut out portion should be large enough to allow a person to contact the note with their finger so that they may slide the note out from under the plate. However, the cut out portion should not be too large so that plate no longer substantially covers the currency note.

In another embodiment the invention is directed to an arm for use in the device previously described. The arm has an upper and lower end with attachment means located at the upper end to allow pivotable attachment of this end of the arm to a cash drawer and attachment means located near the lower end of the arm to allow pivotable attachment of this end to a plate. Preferably the attachment means are lateral projections extending out from both sides of the arm. It is further preferred that the arm is shaped and the projections placed on the arm so that the arm is suitable for pivotable attachment to the plate described above having two housings located on the upper surface of the plate. In this embodiment the arm is shaped so that the lower end can be located substantially between the two housings with each side projection extending into a housing. Preferably the projections on the lower end are located a short distance from the end of the arm and the lower end extends at an angle to the longitudinal axis of the arm to form one or more feet. As the plate is rotated, it comes into abutment with the foot or feet of the arm and this limits the degree of rotation of the plate relative to the arm. In a further preferred embodiment the arm is "H" shaped and is made from a slightly resilient material so that the facing portions of each end of the arm can be pressed toward each other to a certain extent to facilitate the attachment of the arm to a plate and to a cash drawer. The arm may be made out of a plastic material such as polycarbonate and injection moulded.

In a further embodiment, the invention is directed to a cash drawer for storing currency notes having a lower surface against which currency notes can be placed and side walls extending upwards from said lower surface and at least one of the devices of this invention pivotably mounted to or adjacent to a side wall of the drawer so as to permit the plate of the at least one device to be moved into a position where it substantially covers one or more currency notes located in the drawer and contacts the currency notes to hold the notes substantially flat against the said lower surface of the cash drawer.

BRIEF DESCRIPTION OF THE FIGURES OF THE DRAWINGS

The invention shall now be described with reference to the following figures which illustrate a preferred embodiment of this invention.

FIG. 10(*b*) is a side view of the device of FIG. 5 attached to a cash drawer.

DETAILED DESCRIPTION

Figure 1:
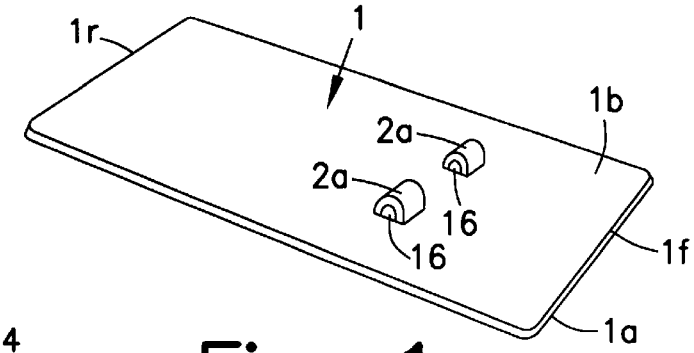
FIG. 1 is an perspective view of a covering plate.

FIG. 1 shows a covering plate 1. The plate 1 has a substantially planar note contacting surface 1*a* and an upper surface 1*b*. Located on the upper surface 1*b* is attachment means which in this embodiment are housings 2*a* which each have an aperture 16. The housings 2*a* are positioned between front edge 1*f* and rear edge 1*r* of plate 1 so that they are suitable for receiving projections located on the end of the arm shown in FIG. 2.

Figure 2:
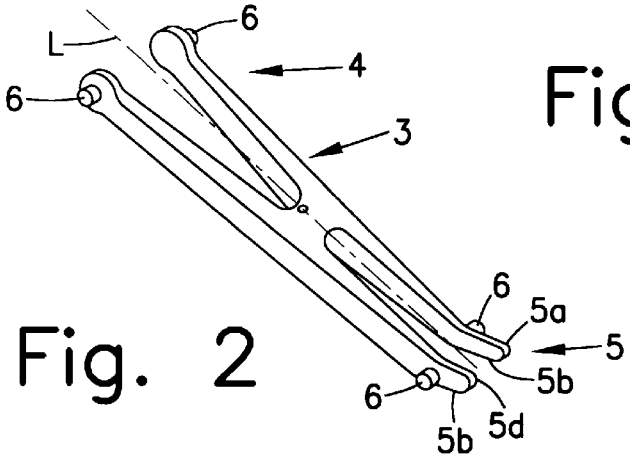
FIG. 2 is a perspective view of an arm suitable for attachment to the covering plate shown in FIG. 1.

FIG. 2 shows an arm 3 suitable for use with the plate 1 shown in FIG. 1. The arm 3 is "H" shaped and has an upper end 4 adapted for pivotable connection to a side of a cash register drawer and a lower end 5 suitable for pivotable connection to plate 1 at a spaced location from front and rear edges 1*f* and 1*r* respectively. Located at the upper end 4 and towards the lower end 5 are projections 6. The lower end 5 of the arm is angled with respect to the longitudinal axis L of the arm 3 to form two feet 5*a* which have lower flat abutting surfaces 5*b*.

Figure 3:
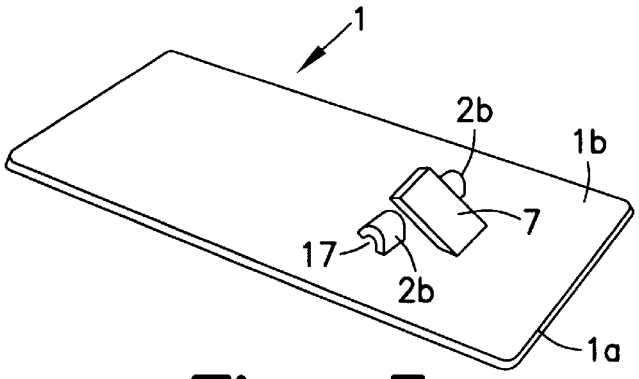
FIG. 3 is a perspective view of another embodiment of a covering plate.

FIG. 3 shows another embodiment of a contacting plate. The plate 1 includes a substantially planar note contacting surface 1*a* and upper surface 1*b*. Extending upward from the upper surface 1*b* are attachment means which in this embodiment are hook shaped projections 2*b* defining openings 17. The hook shaped projections are located on the plate 1 so that they are suitable for engaging the lower sections of a "W" shaped arm shown in FIG. 4. Located in front of the hook shaped projections 2*b* is an abutment means 7. Abutment means 7 is configured and positioned on the plate 1 so that when plate 1 is attached to the arm shown in FIG. 4, rotation of the plate 1 relative to the arm 3 will bring the abutment means into contact with an upper surface of the arm 3 thereby limiting the rotational movement of the plate 1.

Figure 4:
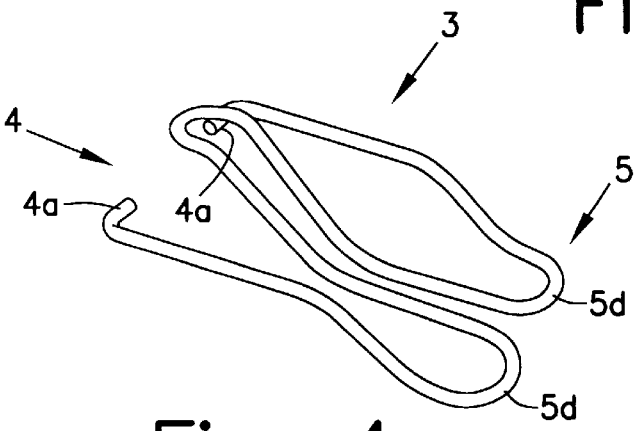
FIG. 4 is a perspective view of an arm suitable for attachment to the covering plate shown in FIG. 3.

FIG. 4 shows an arm 3 suitable for attachment to a plate 1 shown in FIG. 3. The arm 3 has a "W" shape with an upper end 4 and lower end 5. The upper end 4 is pivotably attachable to a cash register drawer. The terminal portions 4*a* of the "W" shaped arm 3 are turned inwards and are adapted to be located in apertures in a side wall of the cash drawer to allow pivotable connection of the arm 3 to the cash drawer. Lower end 5 has rounded portions 5*a*. The hook projections 2*b* on the plate 1 shown in FIG. 3 are spaced apart so that they are suitable for engaging the rounded portions 5*a* of the arm 3. The rounded portions 5*a* can be inserted into the recesses 17 in the hook shaped projections 2*b* so that there is a "snap fit" of the plate 1 to the arm 3. To assist in this "snap fit" it is advantageous if the rounded portions 5*a* of the arm 3 or the housings 2*b* are made of a resilient material. The abutment means 7 is located on the upper surface 1*b* of the plate 1 so that when the plate 1 is attached to the arm shown in FIG. 4, rotation of the plate relative to the arm 3 brings the abutment means 7 in contact with the upper surface of the arm 3 thereby limiting further rotation of plate 1.

Figure 5:
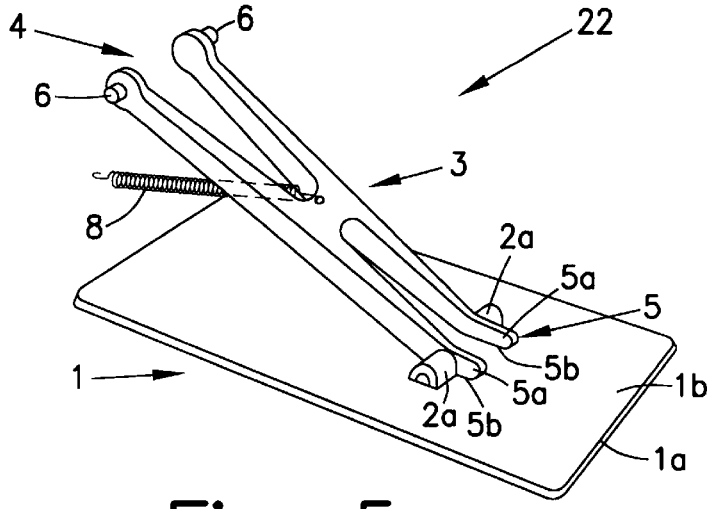
FIG. 5 is a perspective view of a device according to this invention.

Turning to FIG. 5, the plate 1 is attached to arm 3 to form a device 22 of this invention. Lower end 5 of arm 3 is located between housing 2*a* so that projections 6 extend into recesses 16 in housings 2*a* to achieve pivotable connection of the plate 1 to arm 3. The arm 3 is made of a resilient material so that the facing portions of end 4, as well as the facing portions of end 5 can be pushed together. This assists in attaching the device 22 to apertures on a cash drawer and to the housings 2*a* on plate 1. A spring 8 is attached to arm 3.

Figure 6:
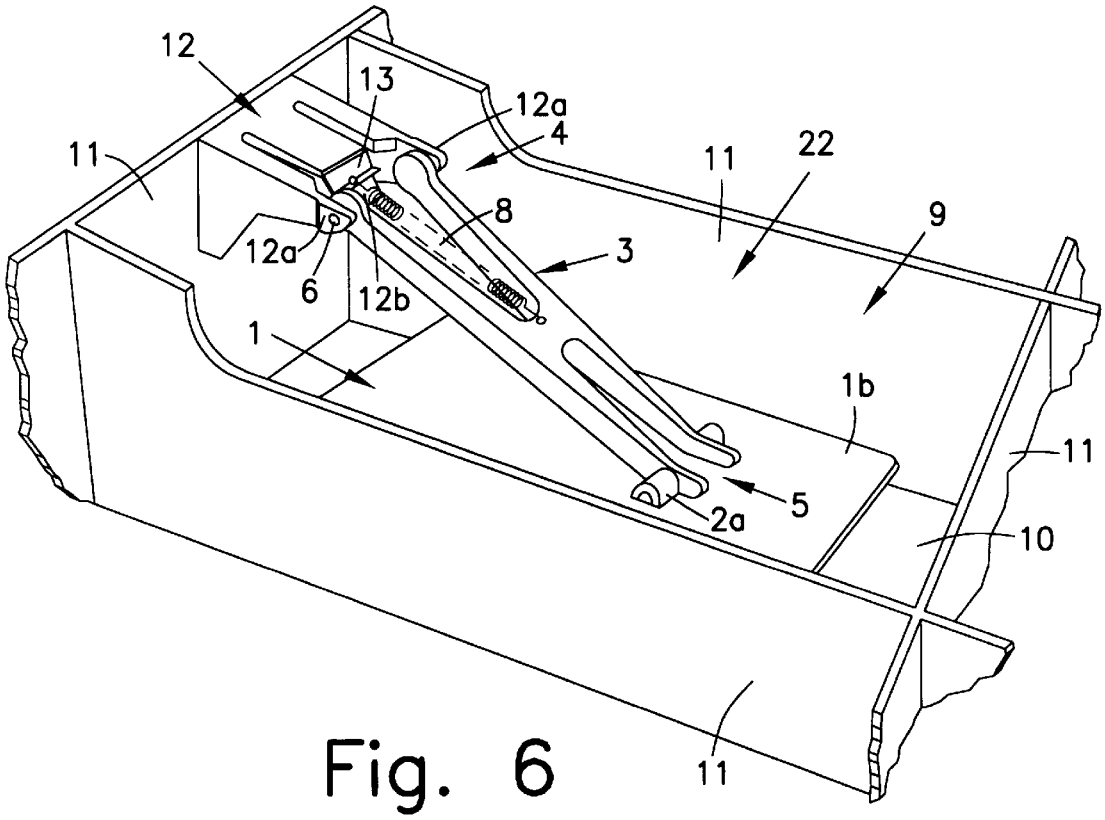
FIG. 6 is a perspective view of the device of FIG. 5 attached to a drawer.

FIG. 6 shows a perspective view of the device 22 of FIG. 5 attached to a compartment 9 of a cash register drawer. The compartment 9 has a flat bottomed surface 10, sidewalls 11 and overhang 12 which extends from a sidewall 11. Apertures 12*a* are located in overhang 12. Overhang 12 also has a downwardly extending projection 12*b*. Projections 6 at upper end 4 of the arm 3 are located in the apertures 12*a* so that the arm 3 is pivotably attached to overhang 12. A sleeve 13 can be fitted to projection 12*b*, the sleeve 13 having an aperture to allow attachment of the spring 8 to the sleeve 13. Of course, in an alternative embodiment, the spring 8 could be directly attached to projection 12*b*. When attached, the spring 8 acts to bias the plate 1 towards the bottom surface 10 of the drawer 9.

Figure 7:
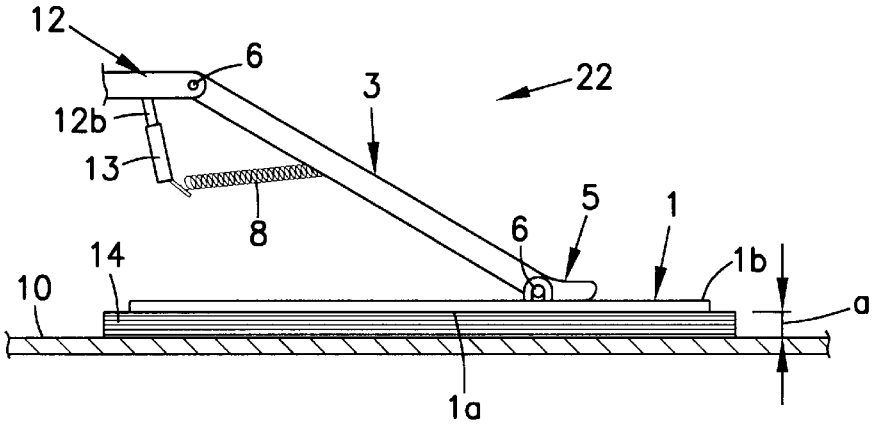
FIGS. 7 & 8 are side views of the device of FIG. 5 attached to a drawer.

FIG. 7 shows a side view of the device 22 of FIG. 5 attached to a drawer. The substantially planar contacting surface 1*a* of plate 1 contacts the uppermost note of a stack of currency notes 14 and the spring 8 assists the plate 1 to press the currency notes 14 substantially flat against the flat surface 10 of the cash drawer. The plate 1 is shaped so that it substantially covers the currency notes 14 and holds the notes 14 substantially flat against surface 10. As can be seen in FIG. 7, contacting surface 1*a* of plate 1 lies substantially parallel to surface 10 and plate 1 is at a distance (a) from surface 10.

Figure 8:
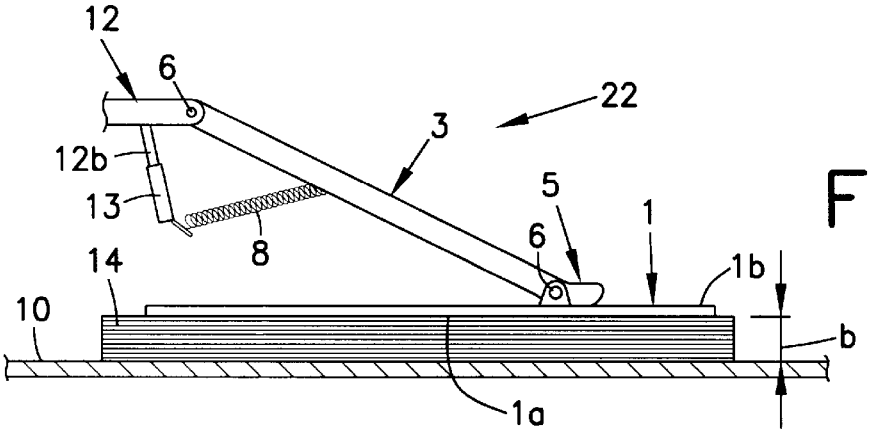

FIG. 8 shows a device 22 of FIG. 5 attached to a drawer, the plate 1 pressing against a greater number of currency notes 14 then shown in FIG. 7. The distance between plate 1 and surface 10 is designated (b) which is greater than distance (a) in FIG. 7. As is illustrated in FIG. 8, the contacting surface 1*a* of plate 1 remains substantially parallel to surface 10. The pivoting attachment of plate 1 to arm 3 allows the plate 1 to remain parallel to surface 10 as the pivoting arm 3 moves away from surface 10 and the distance between plate 1 and surface 10 increases.

In alternative embodiments, arm 3 and spring 8 of the device 22 can be mounted directly to side wall 11 of compartment 9.

Figure 9:
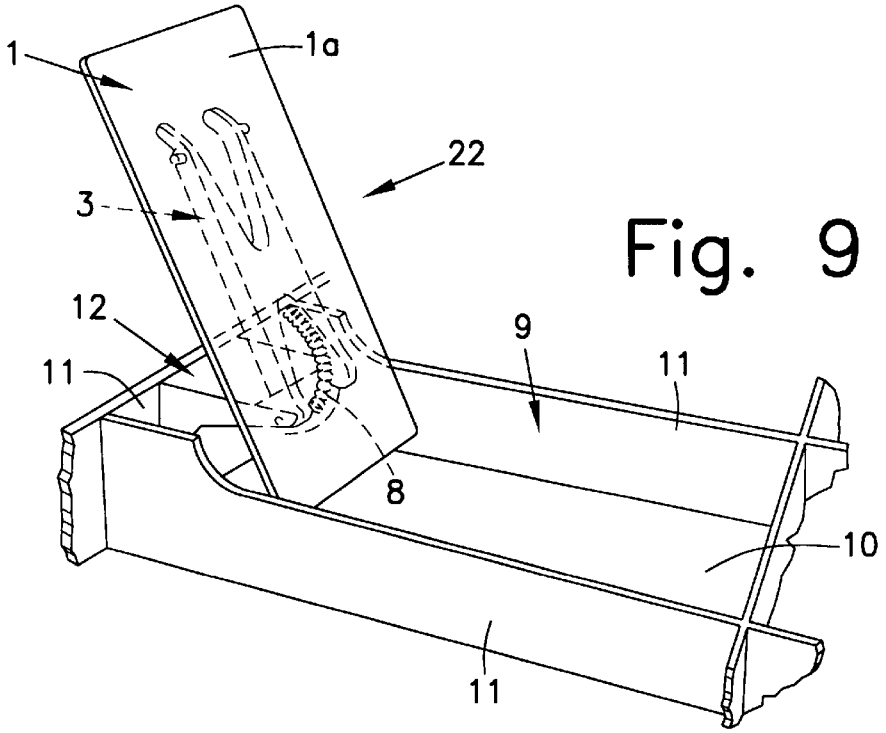
FIG. 9 is a perspective view of the device of FIG. 5 attached to the drawer in an upright position.

In FIG. 9, arm 3 is pivoted to an upright position and plate 1 is substantially upright. This allows the user to easily place notes 14 in the compartment 9. The spring 8 is arranged such that movement of the arm 3 from the upright position toward the surface 10 initially causes the spring 8 to expand. Thus the spring 8 assists in holding the device 22 in the upright position and will bias the device 22 towards the upright position when the device is located close to the upright position.

Figure 10A:
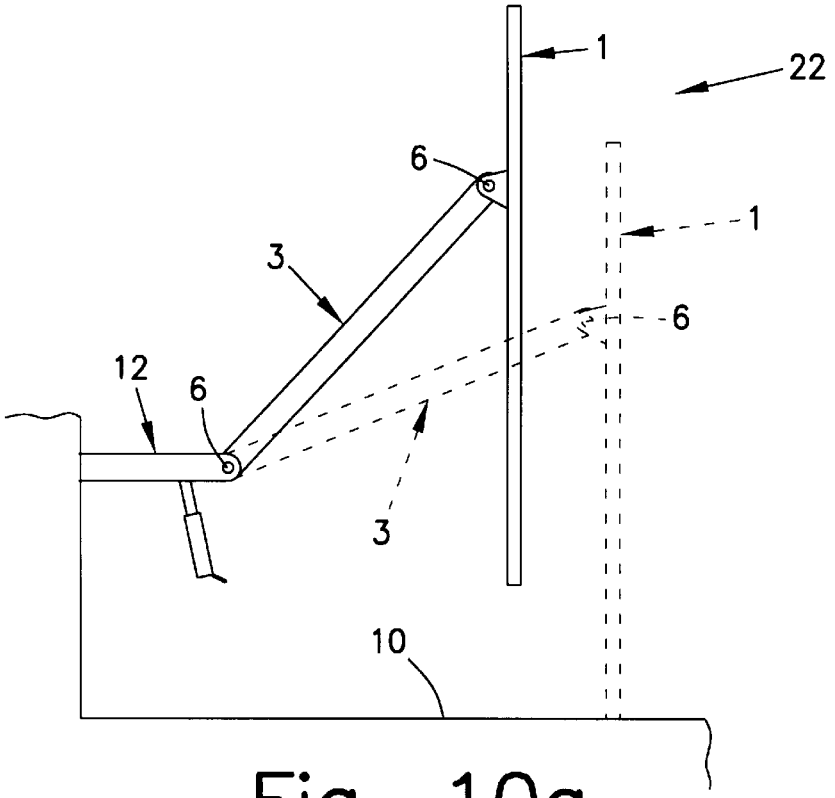
FIG. 10(*a*) is a side view of a device of this invention attached to a cash drawer.
Figure 10B:
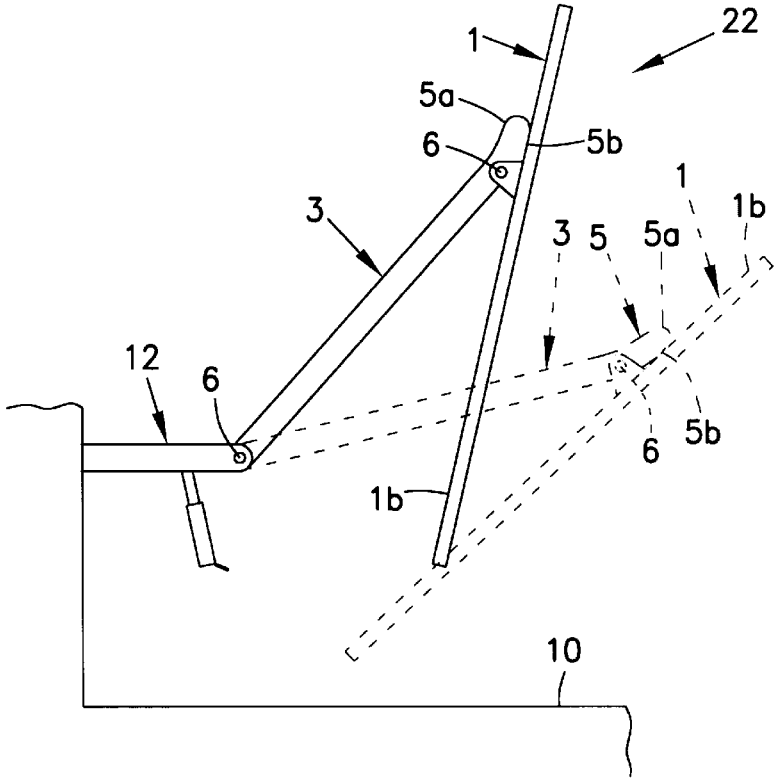

FIGS. 10(*a*) and 10(*b*) show a side view of the device 22 of this invention mounted to an overhanging section 12 of a cash register drawer. In FIG. 10(*a*) arm 3 of the device 22 is located at approximately 45 degrees to the lower surface 10. The plate 1 is substantially vertical. If the plate 1 can remain in this vertical position as arm 3 is moved towards surface 10, the arm 3 will reach a point (shown in dotted lines) where the plate 1 abuts surface 10 thereby preventing further rotation of arm 3. This will hinder movement of the arm 3 from an upright position to the position where it may cover a currency note placed adjacent surface 10. In FIG. 10*b*, the device 22 of FIG. 5 is mounted to the drawer. The lower abutting surfaces 5*b* of the feet 5*a* abut the upper surface 1*b* of the plate 1 limiting the rotation of the plate 1. Accordingly the plate 1 cannot be located in a vertical orientation relative to the lower surface 10. As the arm 3 is rotated toward the lower surface 10 (shown in dotted lines), the plate 1 does not abut the lower surface 10, to prevent further rotation of the arm 1.

Figure 11:
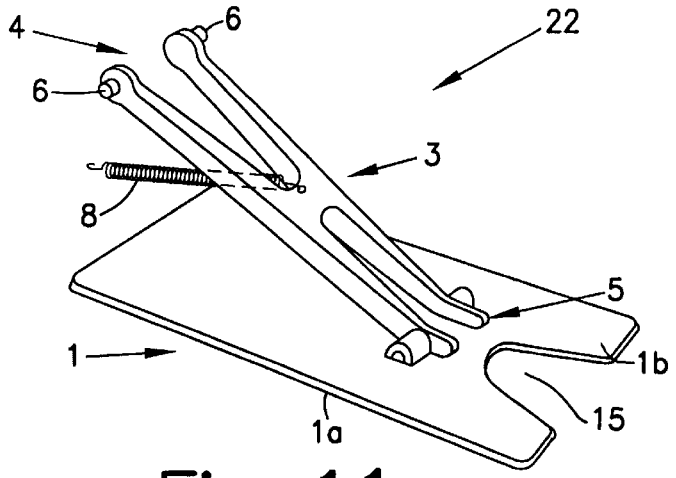
FIG. 11 is a perspective view of another embodiment of this invention showing an arm pivotably attached to a covering plate.

FIG. 11 shows a variation of the device 22 shown in FIG. 5. In FIG. 11 plate 1 has a cut-out portion 15 in the front end of the plate 1. When the device 22 is mounted to a drawer and is in contact with the notes 14 in the drawer, a person can locate one of their fingers in the cut-out portion 15, contact the currency note immediately adjacent to the plate 1 and slide the note out from underneath the plate 1.

Figure 12:
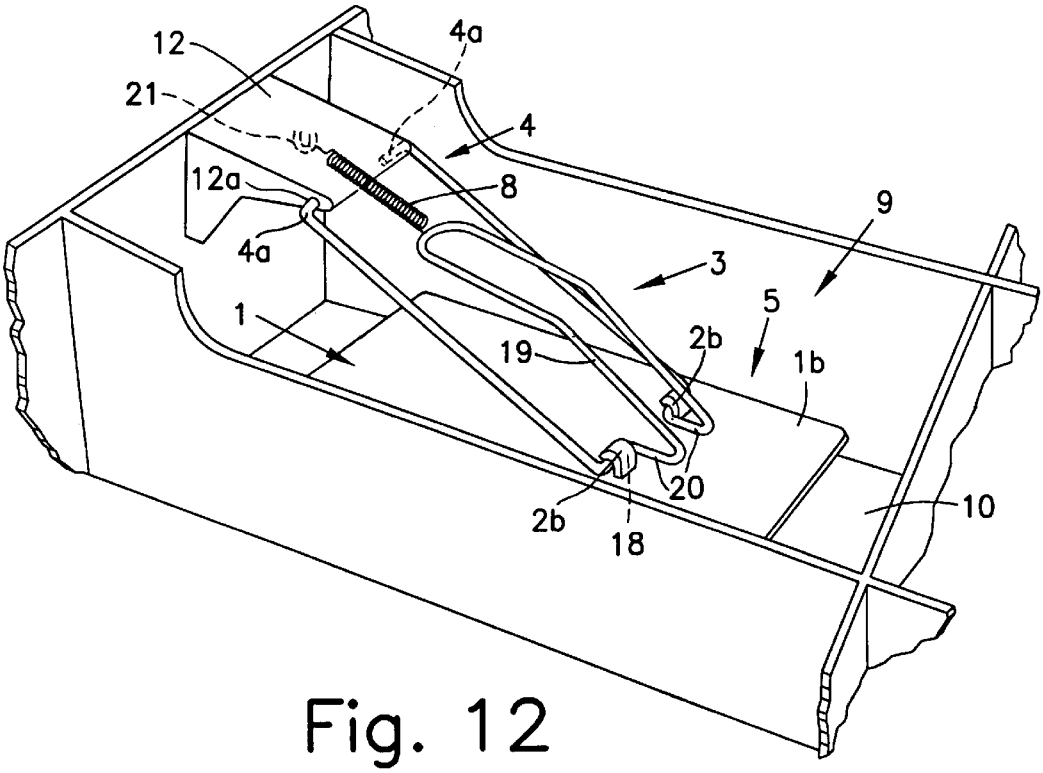
FIG. 12 is a perspective view of a device of another embodiment of this invention attached to a cash register drawer.

Turning to FIG. 12 this figure shows an alternative embodiment of this invention attached to a cash register drawer. As can be seen the arm 3 has an approximately "W" shape. The arm 3 has an upper end 4 and a lower end 5. The terminating portions 4*a* of upper end 4 are turned inwards to allow pivotable attachment to a cash drawer. The compartment 9 of the cash register drawer has overhang 12 and located on overhang 12 are apertures 12*a*. The terminating portions 4*a* of arm 3 are locatable in the apertures 12*a* to allow pivotable attachment of the arm 3 to the cash register drawer. At the lower end 5 of the arm 3, there are located sections 18 which extend in an approximately perpendicular direction to the lengthwise direction of the arm 3. The plate 1 has hook shaped projections 2*b* on the upper surface 1*b* of the plate 1 and these are connected to the arm 3 at locations 18 to achieve pivotable attachment of the plate 1 to arm 3. The center portion of the arm is designated 19 and extends beyond the portion 18 of the arm 3 to form feet 20. Rotation of the plate 1 relative to the arm 3 will bring the top of the plate 1*b* into abutment with the feet 20 to thereby limit the degree of rotation of the plate 1 relative to the arm 3. Spring 8 is attached to the arm 1 at center portion 19 and is attached to a hook 21 attached to overhang 12. The spring 8 acts to biase the plate 1 toward the lower surface 10 of the compartment 9. In an alternative embodiment the plate 1 may have a cut out portion located in front of the plate.

In the embodiment of this invention shown in FIGS. 1 to 12, the plate 1 is made of a transparent material so that currency notes 14 located beneath the plate 1 can be viewed through the plate 1.

It is noted that different denominations of money have different sizes. Accordingly the size of plate 1 can be altered so that it can hold different sized currency notes substantially flat.

It should be understood that various modifications and variations may be made to the device of this invention as hereinbefore described without departing from the spirit and ambit of the present invention.

What is claimed is:

1. A device suitable for hindering the removal of currency notes stored in a cash drawer comprising an arm including means for pivotably mounting the arm to the cash drawer and a covering means having front and rear ends and an area for substantially covering a currency note, the covering means being pivotably attached to the arm at an intermediate position of the covering means spaced away from said front and rear ends, wherein when the arm is pivotably mounted to the drawer the covering means may be located in a position where it substantially covers one or more currency notes stored in the drawer.

2. The device according to claim 1 wherein the covering means has one or more note contacting surfaces located in substantially one plane for contacting a currency note located in the drawer so that the covering means is adapted to hold one or more currency notes substantially flat against a substantially flat surface of the drawer.

3. The device according to claim 2 wherein the covering means comprises a plate having a planar surface which forms one said note contacting surface.

4. A cash drawer for storing currency notes having a lower surface against which currency notes can be placed and one or more side walls extending upwards from said lower surface and the device of claim 3 wherein the device is pivotably mounted adjacent to said one or more side walls of the drawer so as to permit said plate of said device to be moved into a position where it can substantially cover one or more of the currency notes when located in the drawer for holding the one or more notes substantially flat against the said lower surface of the cash drawer.

5. A plate suitable for use as said covering means in the device of claim 1, the plate having a substantially planar lower note contacting surface for contacting all or substantially all of one side of an uppermost one of the currency notes stored in the drawer, the plate further having an upper surface and at least one attachment means located on the upper surface for pivotable attachment of the plate to the arm, said plate having a perimeter, said at least one attachment means being located away from the perimeter of the plate and from said front and rear ends to allow attachment of the plate to said arm.

6. The plate according to claim 5 wherein the plate has two attachment means and each attachment means comprises a housing having an aperture adapted to receive a projection located on said arm so as to allow pivotable connection of the plate to the arm.

7. The plate according to claim 6, wherein the plate includes an abutment means extending from the upper surface of the plate, wherein the abutment means is capable of being brought into contact with said arm when said arm is attached to the plate so as to limit the rotational movement of the plate relative to the arm.

8. The plate according to claim 5 wherein the plate has two attachment means and each attachment means comprises a hook-shaped projection defining an opening which is adapted to receive a projection located on said arm to allow pivotable connection of the plate to the arm.

9. The plate according to claim 8 wherein the plate includes an abutment means extending from the upper surface of the plate, wherein the abutment means is capable of being brought into contact with said arm when said arm is attached to the plate so as to limit the rotational movement of the plate relative to the arm.

10. A device for hindering the removal of currency notes stored in a cash drawer including an arm which may be pivotably mounted to the cash drawer, and a plate having a note contacting surface having an area for substantially covering a currency note, wherein the plate is pivotably mounted to the arm and has on an upper surface an abutment means which is capable of being brought into contact with the arm on rotation of the plate, the abutment means limiting the pivotable movement of the plate in relation to the arm to less than 90°.

11. The device according to claim 10 wherein the plate has located on the upper surface one or more projections each defining an opening which is adapted to receive a portion of the arm to permit pivotable attachment of the plate to the arm.

12. A device suitable for hindering the removal of currency notes stored in a cash drawer comprising an arm pivotably mountable to the cash drawer and a covering means having an area for substantially covering a currency note, the covering means being pivotably attached to the arm at a point adjacent to a lower end of the arm so that a portion of the lower end extends past the point where the arm is pivotably attached to the covering means so that rotation of the covering means relative to the arm brings the covering means into abutment with the lower end of the arm thereby limiting the rotational movement of the covering means relative to the arm, wherein when the arm is pivotably mounted to the drawer the covering means may be located in a position where it substantially covers one or more currency notes stored in the drawer.

13. The device according to claim 12, wherein the covering means has one or more note contacting surfaces located in substantially one plane for contacting a currency note located in the drawer so that the covering means is adapted to hold one or more currency notes substantially flat against a substantially flat surface of the drawer.

14. The device according to claim 13, wherein the covering means comprises a plate having a planar surface which forms one said note contacting surface.

15. The device according to claim 14 wherein the portion of the lower end of the arm extends at an angle to a longitudinal axis of the arm to form one or more feet.

16. The device according to claim 15 wherein the arm includes one or more lateral projections adjacent to its lower end and the plate includes on an upper surface one or more housings each having an aperture for receiving the one or more lateral projections to allow pivotable attachment of the arm to the plate.

17. A cash drawer for storing currency notes having a lower surface against which currency notes can be placed and one or more side walls extending upwards from said lower surface and the device of claim 14 wherein the device is pivotably mounted adjacent to the one or more side walls of the drawer so as to permit said plate of said device to be moved into a position where it can substantially cover one or more of the currency notes when located in the drawer for holding the one or more notes substantially flat against the said lower surface of the cash drawer.

18. The device according to claim 14 further including a biasing means attached to the arm and attachable to the cash drawer when the arm is mounted to the cash drawer so as to bias the plate toward a lower surface of the cash drawer.

19. The device according to claim 18 wherein the arm is pivotably mounted to the plate at a location away from the perimeter of the plate.

20. The device according to claim 13, wherein the pivotable movement of the plate in relation to the arm is limited to less than 90 degrees.

* * * * *